US009832579B2

(12) United States Patent
Karamuk et al.

(10) Patent No.: US 9,832,579 B2
(45) Date of Patent: Nov. 28, 2017

(54) ENCAPSULATED HEARING DEVICE

(71) Applicant: Sonova AG, Stafa (CH)

(72) Inventors: Erdal Karamuk, Mannedorf (CH); Bruno Gabathuler, Gruningen (CH); Andi Vonlanthen, Oberrohrdorf (CH); Stephanie Thomas, Wadenswil (CH); Markus Muller, Mannedorf (CH)

(73) Assignee: Sonova AG, Stäfa (CH)

( * ) Notice: Subject to any disclaimer, the term of this patent is extended or adjusted under 35 U.S.C. 154(b) by 0 days.

(21) Appl. No.: 14/428,678

(22) PCT Filed: Sep. 18, 2012

(86) PCT No.: PCT/EP2012/068330

§ 371 (c)(1),
(2) Date: Mar. 17, 2015

(87) PCT Pub. No.: WO2014/044291

PCT Pub. Date: Mar. 27, 2014

(65) Prior Publication Data

US 2015/0249896 A1 Sep. 3, 2015

(51) Int. Cl.
*H04R 25/00* (2006.01)

(52) U.S. Cl.
CPC ..... *H04R 25/65* (2013.01); *H04R 25/608* (2013.01); *H04R 25/658* (2013.01); *H04R 2225/023* (2013.01)

(58) Field of Classification Search
CPC .... H04R 25/65; H04R 25/652; H04R 25/602; H04R 25/608
USPC ..... 381/322, 328
See application file for complete search history.

(56) References Cited

U.S. PATENT DOCUMENTS

| | | | | |
|---|---|---|---|---|
| 7,580,537 | B2 * | 8/2009 | Urso | H04R 25/652 381/322 |
| 2002/0025055 | A1 * | 2/2002 | Stonikas | H04R 25/652 381/322 |
| 2004/0252854 | A1 * | 12/2004 | Juneau | C07D 493/10 381/324 |
| 2010/0034410 | A1 * | 2/2010 | Link | H04R 25/60 381/328 |

(Continued)

FOREIGN PATENT DOCUMENTS

| | | | |
|---|---|---|---|
| EP | 0 026 247 | B1 | 12/1984 |
| WO | 00/53094 | A1 | 9/2000 |

(Continued)

OTHER PUBLICATIONS

International Search Report for PCT/EP2012/068330 dated May 6, 2013.

(Continued)

*Primary Examiner* — Sunita Joshi
(74) *Attorney, Agent, or Firm* — Sonova AG

(57) ABSTRACT

The present invention relates to an encapulated hearing device (50), e.g. for long-term wear, in which an electronics module (10) is encapsulated into a thermoformed hull (30) by means of an appropriate adhesive (41). This thermoformed hull (30) acts as an improved barrier between the electronics module (10) and the environment of the inner ear, reducing the risk of moisture reaching electrical components.

17 Claims, 6 Drawing Sheets

(56) References Cited

U.S. PATENT DOCUMENTS

2013/0129128 A1* 5/2013 Wagner ..... H04R 25/602
381/323

FOREIGN PATENT DOCUMENTS

WO 02/03757 A1 1/2002
WO 2009/138895 A1 11/2009

OTHER PUBLICATIONS

Written Opinion for PCT/EP2012/068330 dated May 6, 2013.
European Search Report for 12 761 978.1 dated Aug. 31, 2016.

* cited by examiner

ENCAPSULATED HEARING DEVICE

FIELD OF THE INVENTION

The present invention relates to encapsulated hearing devices, such as hearing aids intended for extended wear deep inside the ear canal.

BACKGROUND OF THE INVENTION

Extended wear hearing aids are intended for patients with low to moderate levels of hearing loss. There are intended to be disposed in the bony region of the ear canal, up to approximately 4 mm from the tympanic membrane. They are intended to remain in place for a period of several weeks or even months without the need to remove the device, and will typically only be removed when the battery is exhausted.

Generically, such devices are subject to a variety of constraints, including but not limited to:

- in order to have the highest possible fit rate for the largest number of individuals, the outer dimensions of the device must be minimum, thus the size and thickness of the outer hull or housing must likewise be kept to a minimum;
- the hearing aid will be worn for a long period in a moist environment (the inner ear). Thus a very low moisture transmission rate of the packaging is necessary in order to protect the electronic components and to avoid leakage current therein. Furthermore, nickel release from the components of the module must be kept below the release limits defined in ISO 1811: 0.2/0.5 μg $Ni/cm^2$/week;
- the hearing aid must not undergo degradation or a change of structural integrity in prolonged contact with sweat and/or cerumen;
- skin biocompatibility with regard to ISO 10993-1 must be assured;
- the dimensions should not exceed 11.3 mm in length and 3.4×6.4 mm in cross-section.

SUMMARY OF THE INVENTION

An object of the present invention is thus to provide a hearing device of the above-mentioned type, which exhibits at least one of the following:

- minimal variation of final outer dimensions from hearing device to hearing device;
- consistent module placement from hearing device to hearing device;
- minimum exterior dimensions;
- excellent protection of electronic components from extended exposure to sweat and/or cerumen;
- minimal requirement for rework of finished hearing devices.

Although the invention primarily relates to hearing aids, it equally applies to other types of hearing device, by which we understand communication device earpieces, active hearing protection for gunfire or other loud noises, tinnitus treatment devices, etc. Furthermore, it should be noted that the hearing device of the invention can equally be applied to conventional short-term wear hearing devices, although it is particularly applicable to the above-mentioned extended-wear types.

An object of the present invention is attained by a hearing device comprising a single-piece thermoformed hull provided with at least one opening. Such a thermoformed hull would typically be a hull with a wall thickness of between 20-100 μm depending on the raw material sheet used. The hearing device further comprises an electronics module comprising a microphone in communication with a sound inlet, a battery, and a loudspeaker in communication with a sound outlet, wherein the electronics module is disposed in the hull with the sound outlet in communication with the opening. The entire electronics module with the exception of at least part of the sound inlet (to allow sound to enter) and at least part of the sound outlet (to allow sound to exit) is encapsulated into the hull by an adhesive.

Compared with e.g. hearing devices encapsulated within e.g. a silicone rubber mold, the positioning of the electronics module in the thermoformed hull is more consistent than in a silicone mold, since a thermoformed hull is less flexible than a silicone mold. As a result, the distribution of adhesive is rendered more consistent, thus the encapsulation is improved, reducing the chance of moisture breaching the encapsulation, and reducing the requirement for rework. Furthermore, the thermoformed hull itself provides a significantly better barrier to moisture than the encapsulation adhesive alone used in a silicone form.

In an embodiment, a tube is attached to the sound outlet, for instance by bonding with an appropriate adhesive if required, or by an elastic or force fit. This tube assists in communication between the sound outlet and the opening in the hull.

In an embodiment, the tube protrudes through the opening in the hull. This provides several extra functions to the tube: firstly, it helps in alignment and insertion of the electronics module into the hull since during insertion, once it has passed through the opening in the hull it will help guide the electronics module the rest of the way into the hull; secondly, it acts as a seal between the electronics module and the hull, preventing the encapsulation adhesive from entering the sound opening and thus reducing functionality of the hearing aid; and thirdly it acts as a wax guard against cerumen entering the medial sound port of the device.

In an embodiment, the tube is of substantially cylindrical or hollow-truncated-conical (i.e. hollow truncated cone) shape. The cylindrical shape is simple to produce, and the hollow-truncated-conical shape further assists in insertion of the electronics module into the hull, due to its taper.

In an embodiment, the battery is hardwired to the electronics module, resulting in simple construction and reducing the overall size of the hearing device by not requiring contacts or a battery hatch.

In an embodiment, the electronics module is provided with an extraction loop proximate to the sound inlet, that is to say nearer to the sound inlet that the sound outlet. This permits easy extraction of the hearing device and simple construction.

In an embodiment, the hearing device further comprises a silicone rubber earmold or a compressible seal, e.g. made of a soft, compressible foam, disposed around the hull, either of which permits the hearing device to precisely fit the ear canal of the wearer. The hearing device is thus comfortably held in place, and sound cannot escape between the hearing device and the wall of the ear canal causing feedback.

In an embodiment, the hull is sized such that it is deformed by the electronics module, i.e. the outer surface of the hull exhibits the contours of the electronics module contained therein. This provides a tight fit between the electronics module and the hull, resulting in a minimum size of the hearing device, thus improving the fit rate for individual ear canals.

In an embodiment, the hearing device further comprises a vent tube encapsulated into the hull. The vent tube has a first end in communication with a further opening provided in the second end of the hull and a second end protruding from the encapsulation adhesive proximate to the open first end of the hull. This tube enables rapid equalization of pressure during rapid altitude changes by permitting airflow through itself, eliminating the discomfort that a trapped pressure differential can cause to the wearer. By appropriately dimensioning the tube, e.g. with an interior diameter of 0.20-0.30 mm (e.g. 0.25 mm), and a wall thickness of 0.05-0.10 mm, equalisation of pressure can take place in approximately 0.05 seconds, yet the tube does not permit significant passage of sound above about 50 Hz, hence is irrelevant for feedback between the sound output and the sound inlet.

An object of the invention is likewise achieved by a method of manufacturing a hearing device, comprising providing a sheet of thermoformable material, thermoforming and separating a hull blank from the sheet of thermoformable material, said hull blank comprising an open end and a closed end, in which at least one opening is then formed thereby forming a hull. An electronics module comprising a microphone in communication with a sound inlet, a battery, and a loudspeaker in communication with a sound outlet is provided, and is inserted into the hull such that the sound outlet is in communication with the opening. Subsequently, the electronics module with the exception of at least part of the sound inlet and at least part of the sound outlet is encapsulated into the hull by an adhesive, e.g. an epoxy or acrylic resin.

This results in a hearing device which, compared with the above-mentioned prior art hearing devices encapsulated within a silicone form, the positioning of the electronics module in the thermoformed hull is more consistent than in a silicone form, since the thermoformed hull is less flexible than a silicone form. As a result, the distribution of adhesive is rendered more consistent, thus the encapsulation is improved, reducing the chance of moisture breaching the encapsulation, and reducing the requirement for rework. Furthermore, the thermoformed hull itself provides a superior barrier to moisture than the encapsulant alone, since there is always the risk that certain areas of the device such the battery or the transducers are in direct contact with the silicone mold and are thus not encapsulated, which can lead to increased nickel release in contact with sweat and during extended wear and also can be a starting point for breaches to moisture.

In an embodiment, before insertion of the electronics module into the hull, a tube is attached to the sound outlet. This tube assists in communication between the sound outlet and the opening in the hull.

In an embodiment, during insertion of the electronics module into the hull, the tube passes through the opening so as to protrude therefrom. This helps in alignment and insertion of the electronics module into the hull since during insertion, once it has passed through the opening in the hull it will help guide the electronics module the rest of the way into the hull. Furthermore, the tube will act as a seal between the electronics module and the hull, preventing the encapsulation adhesive from entering the sound opening and thus reducing functionality of the hearing aid or leaking out during the filling of the hull. This has the additional benefit that very low viscosity encapsulation resins can be used which is of great benefit for the encapsulation quality, since lower viscosity fluids can flow more easily around all the module components and between the module components and the hull. Additionally, the tube will act as a wax guard like extended receiver tubes known to work well in custom in-ear hearing aids.

In an embodiment, a further opening is additionally formed in the closed end of the hull blank for the passage of an end of a vent tube, which is inserted into the hull together with the electronics module, with the other end of the vent tube protruding from the open end of the hull. This tube is then encapsulated together with the electronics module into the hull, and enables rapid equalisation of pressure during rapid altitude changes by permitting airflow through itself, eliminating the discomfort that a trapped pressure differential can cause to the wearer. By appropriately dimensioning the tube, e.g. with an interior diameter of 0.20-0.30 (e.g. 0.25 mm), and a wall thickness of 0.05-0.10 mm, equalisation of pressure can take place in approximately 0.05 seconds, yet the tube does not permit significant passage of sound above about 50 Hz, hence is irrelevant for feedback between the sound output and the sound inlet.

In an embodiment, after encapsulation, excess vent tube material protruding from the hull and from the encapsulation is trimmed either flush therewith, or to within 2 mm therefrom. This eliminates any sharp edges caused by the vent tube and prevents the vent tube from interfering with parts of the wearer's ear.

In an embodiment, the hull blank is separated from the sheet of thermoformable material by laser cutting or by hot-wire cutting, and the opening or openings is/are likewise formed by laser cutting or hot-wire cutting. These are accurate, fast and cheap ways to separate the hull blank from the thermoformable sheet and to pierce the opening. Likewise, if required, the hull blank can be trimmed to the desired length also by laser cutting or hot-wire cutting. It should be noted that the separation of the hull blank and the forming of the opening do not have to be carried out by the same process.

In an embodiment, the thermoformable material is one of BAREX (Acrylonitrile/Methyl acrylate), PET-GAG (Polyethylene Terephthalate Glycol), COP (Cyclo Olefin Polymer), or PEEK (Polyetheretherketone). These materials are biocompatible and furthermore possess the required thermoforming and barrier properties.

In an embodiment, the adhesive is applied by means of a cannula, which enables precise application and dosing of the adhesive.

In an embodiment, the adhesive is a UV or light curable epoxy, and the adhesive is cured by means of UV radiation or light in an appropriate wavelength range, which serves to provide a strong, secure encapsulation.

BRIEF DESCRIPTION OF THE DRAWINGS

Non-limiting exemplary embodiments of the present invention will now be described with reference to the following figures, which show.

In the figures, like reference signs refer to like parts.

DETAILED DESCRIPTION OF THE DRAWINGS

Figure 1:
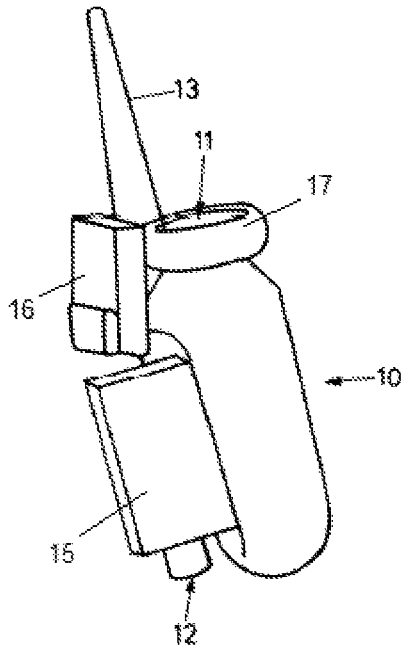
FIG. 1—a perspective view of an electronics module of a hearing device.

FIG. 1 shows an electronics module 10 comprising, as is conventional, an acoustic hybrid comprising a microphone 17 in communication with a sound inlet 11, a sound outlet 12 leading from a loudspeaker 15 (also referred to in the industry as a receiver) and a battery 16. In the illustrated example, the sound outlet 12 forms a cylindrical spout, although other forms are possible. The layout of the electronics module 10 is conventional, and thus need not be discussed further. An extraction loop 13 is provided at the end of the electronics module 10 proximate to the sound inlet 11, and serves to facilitate extraction of the hearing device from the ear canal by means of a tool.

Figure 2:
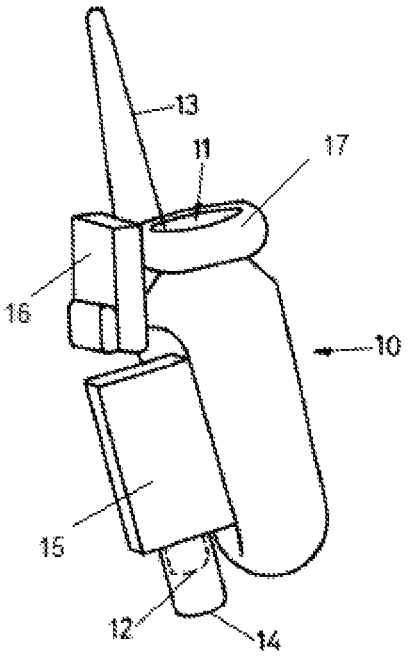
FIG. 2—a perspective view of the electronics module of FIG. 1 fitted with a tube.

FIG. 2 shows the electronics module 10 as in FIG. 1, with the addition of a tube 14 attached to the sound outlet 12 by means of an appropriate adhesive. This tube has several functions: firstly, it acts as an aid to insertion of the electronics module 10 into the hull (see below) by helping to align the electronics module 10 with the opening in the hull; secondly, it protects the loudspeaker 15 of the electronics module 10 from the encapsulation material by virtue of preventing said encapsulation material from being able to enter the sound outlet 12 and thereby reach the loudspeaker 15; thirdly, it seals against the hull, permitting a very low viscosity adhesive to be used for encapsulation; and fourthly it acts as a wax guard during insertion of the hearing device into the auditory canal of the wearer. The tube 14 may be of any convenient shape such as cylindrical or truncated conical, and may be made from any convenient material, such as soft thermoplastic or silicone rubber. However, tube 14 is not essential and could for instance be simply omitted. Alternatively, the sound outlet spout 12 could be configured so as to perform the same functions, e.g. by being extended such that it will protrude from the hull and form a tight seals with the hull when assembled.

Figure 3:
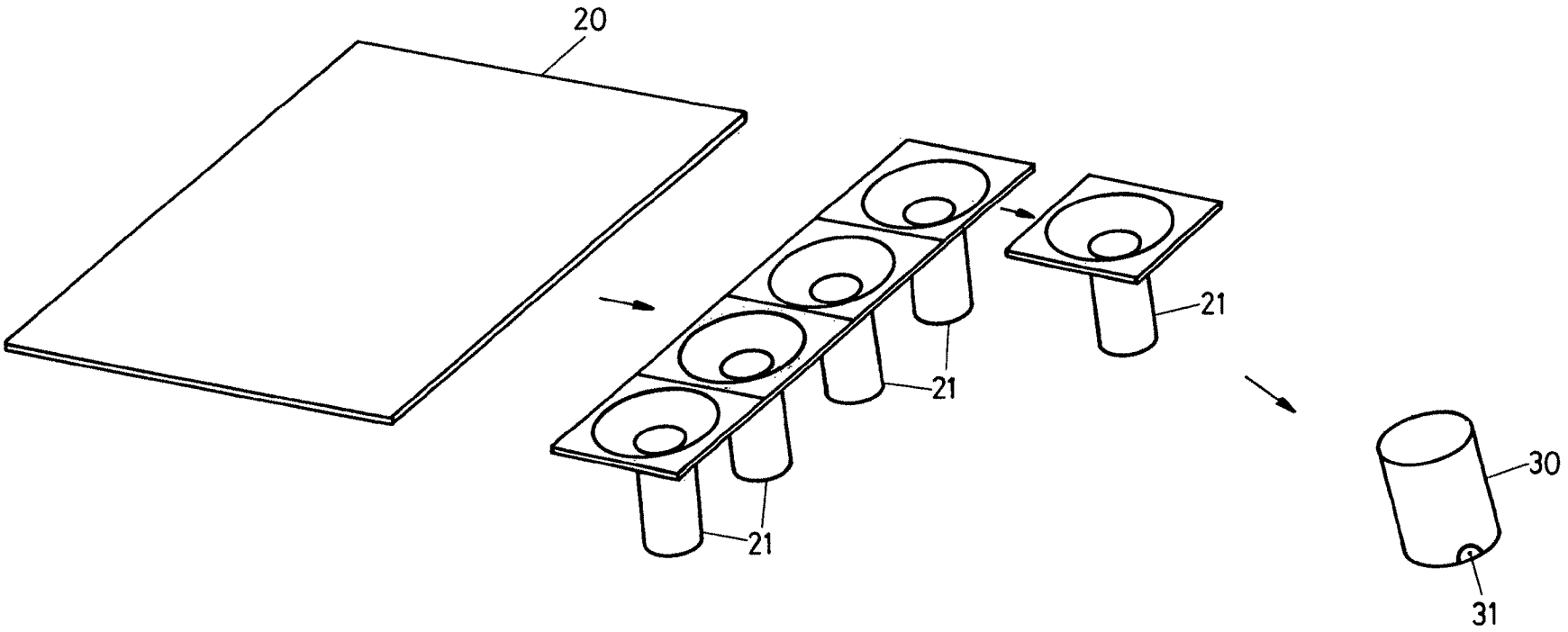
FIG. 3—a perspective view of the stages of manufacturing the hull of a hearing device according to the invention.

FIG. 3 illustrates the steps for manufacturing a hull 30 for a hearing device according to the invention. Firstly, a sheet 20 of an appropriate thermoformable material with an appropriate thickness to achieve the desired final wall thickness of the hulls (e.g. a final sidewall thickness of 20-100 μm) is provided. The hull 30 may thus equally be described as a hull with a sidewall thickness of 20-100 μm. Suitable materials include but are not limited to BAREX, PET-GAG, COP and PEEK, which are used in the food and drug packaging and medical industries. These materials not only have the required thermoforming properties, but also serve as effective barrier materials to moisture, for instance from cerumen, sweat, soapy water and so on, and also to metal ions such as nickel released from module components.

A plurality of hull blanks 21 are then formed by conventional thermoforming. This process generically entails taking the sheet 20 of thermoformable material, placing it over a vacuum-forming mould, which may define the outer or inner contour of the hull blanks, heating the thermoformable material, and moulding it by means of a vacuum. Alternatively, a two-part mould defining both the inner and outer contours and operated with or without vacuum may be used. After ejection of the thus moulded sheet from the mould, the hull blanks 21 are separated from the sheet 20 e.g. by laser cutting or die cutting. Finally, the hull blanks 21 are trimmed to length e.g. by laser cutting or hot-wire cutting, and an opening 31 for the sound outlet 12 and/or tube 14 is created in the closed-end of the whole blank 21, again e.g. by laser cutting or die-cutting.

It should be noted that the use of a mould which defines the inner contour of the hull blanks 21, whether used alone or in combination with a corresponding outer-contour mould, presents the advantage that the interior contour and interior volume of the hulls, in which the electronics module will be placed, are essentially constant with a high tolerance independent of variations in sheet material thickness, thus the relationship between the size of the electronics module and the hulls is likewise kept to within high tolerances, giving excellent consistency between individual hearing devices.

These thermoformed hulls 30 are easily distinguishable from hulls or shells produced by other processing techniques such as injection moulding. Firstly, thermoforming enables the wall thickness of the hull 30 to be significantly thinner (approximately 50-100 μm, or even 20-100 μm) than those produced e.g. by injection moulding: injection moulded hulls are typically 3 to 5 times thicker due limitations of the process. As a result, they are relatively rigid, and either exhibit visible seams and/or sprues, or must be created as two half-shells, such as that described in U.S. Pat. No. 7,092,543. Since the thermoformed hulls have significantly thinner walls than injection moulded hulls, or hulls produced by other methods, they are relatively elastic and flexible. Secondly, the orientation of the crystal structure of the plastic material is identifiably different in a thermoformed hull compared with an injection moulded hull.

Figure 4:
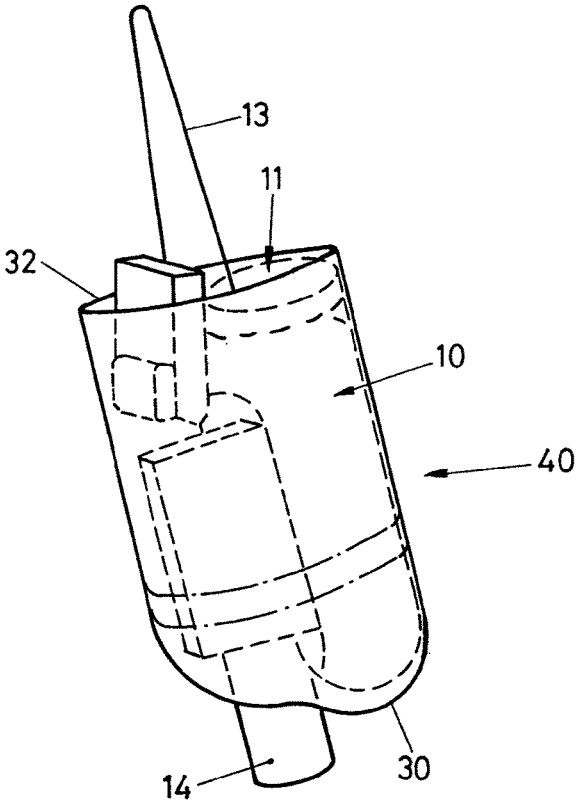
FIG. 4—a perspective view of an assembled hearing device.

FIG. 4 illustrates an assembled hearing device 40. Electronics module 10, complete with tube 14, has been inserted into hull 30 such that the tube 14 protrudes through the opening 31 (not visible on FIG. 4). Since the tube 14 protrudes from the electronics module 10, it assists in insertion and alignment of the electronics module 10 into the hull 30. To ensure that the outer dimensions are kept to a minimum, the fit between the electronics module 10 and the hull 30 can be so tight that the electronics module 10 deforms the hull 30 and leaves an impression therein. Alternatively, the fit can be looser, which enables a greater quantity of encapsulant material such as UV-curable epoxy to be distributed between electronics module 10 and hull 30.

Figure 5:
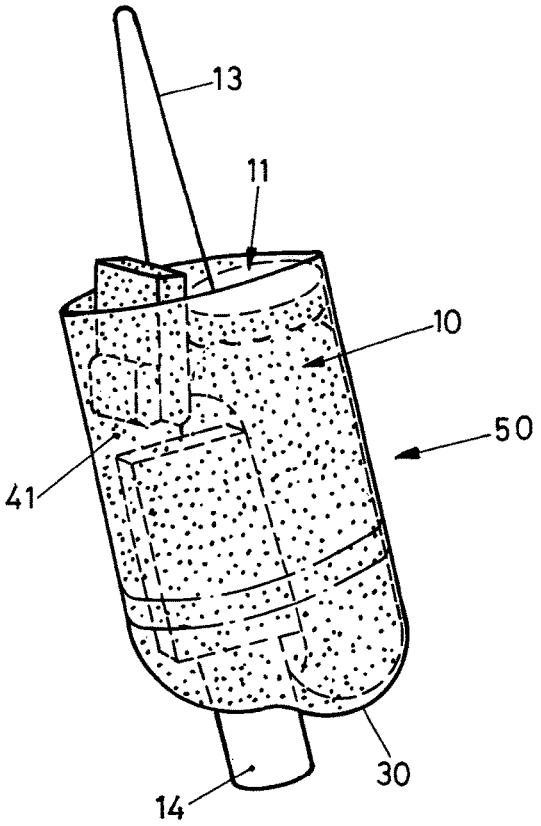
FIG. 5—a perspective view of a fully assembled and encapsulated hearing device according to the invention.

As illustrated in FIG. 5, the electronics module 10 is encapsulated into the hull 30 by means of appropriate adhesive 41, represented in FIG. 5 by dots, resulting in a fully assembled and encapsulated hearing device 50. This adhesive may be applied with a cannula 43 in the gaps between the electronics module 10 and the hull 30, for instance via open end 32 of the hull 30, or by any other convenient means. The entire electronics module 10 is encapsulated into the hull 30 with the exception of the sound inlet and the sound outlet, which in the case of the embodiment of FIG. 5 is protected by the tube 14. In the case in which the adhesive is a UV-curable or light-curable epoxy, the applied adhesive is then cured by means of light in an appropriate wavelength range. If required, the thus assembled hearing device 50 can then be provided with a silicone sleeve and other attributes as is standard (not illustrated).

Figure 6:
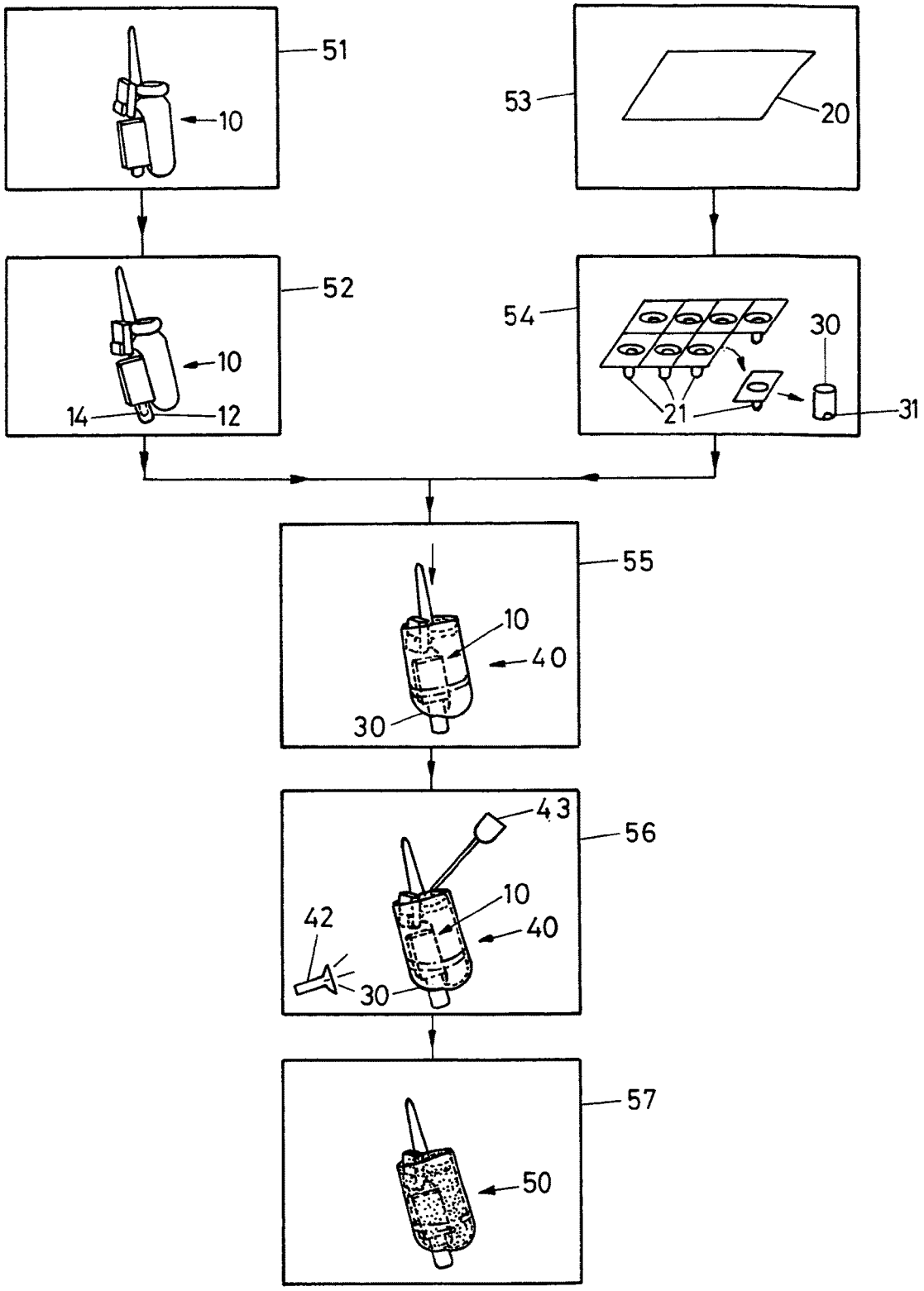
FIG. 6—a flowchart of a method of manufacturing a hearing device according to the invention.

FIG. 6 illustrates the overall process in block-diagram form. In block 51, the electronics module 10 is provided, and in block 52, tube 14 (if required) is applied and bonded (if necessary) to the sound outlet 12 of the electronics module 10. In block 53, a sheet 20 of thermoformable material is provided, and in block 54 the sheet 20 is thermoformed into hull blanks 21, which are separated from the sheet, trimmed (if required), and pierced with opening 31 e.g. by means of laser cutting, thereby resulting in hull 30. In block 55, the electronics module 10 is inserted into the hull 30, creating an assembled hearing device 40. In block 56, the electronics module 10 is encapsulated into the hull 30 by means of an appropriate adhesive, e.g. a UV or light-curable epoxy, which may be applied by a cannula 41 and cured by means of a UV light source 42, and in block 57 the fully assembled and encapsulated hearing device 50 is complete.

Figure 7:
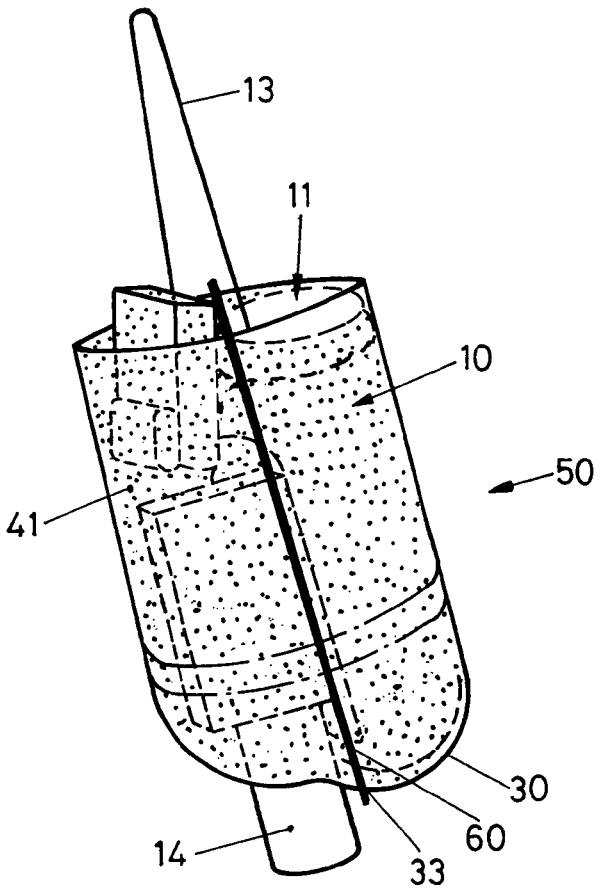
FIG. 7—a perspective view of a fully assembled and encapsulated hearing device according to a further embodiment of the invention.

FIG. 7 shows a further embodiment of the hearing device according to the invention, which differs from that described above in that a vent tube 60 is additionally encapsulated into the hull 30. For clarity, this vent tube has been illustrated in solid line even though it is situated inside the hull 30. The vent tube is inserted at the same time or before insertion of the electronics module 10 into the hull 30. The vent tube 60 extends from an additional opening 33, pierced in the same step as opening 31, proximate to the opening 31 in what was the closed-end of the hull blank 21 to outside of the encapsulated adhesive proximate to the open end 32 of the hull 30, near to the hull 30, although this may naturally be situated anywhere desired. As illustrated, the vent tube 60 protrudes from each end of the hull 30, for instance by no more than 2 mm. However, it can also be cut off substantially flush with both the hull 30 and the encapsulation material 41. The vent tube may, for instance, have an interior diameter of 0.20-0.30 (e.g. 0.25 mm), have a wall thickness of 0.05-0.10 mm and be made of polyimide (PI) or any other suitable material. Such dimensions do not result in a critical feedback between the sound output and the sound input since such a tube is acoustically opaque above 50 Hz. It does, however, permit equalization of pressure within approximately 0.05 seconds during rapid changes in ambient pressure.

Figure 8:
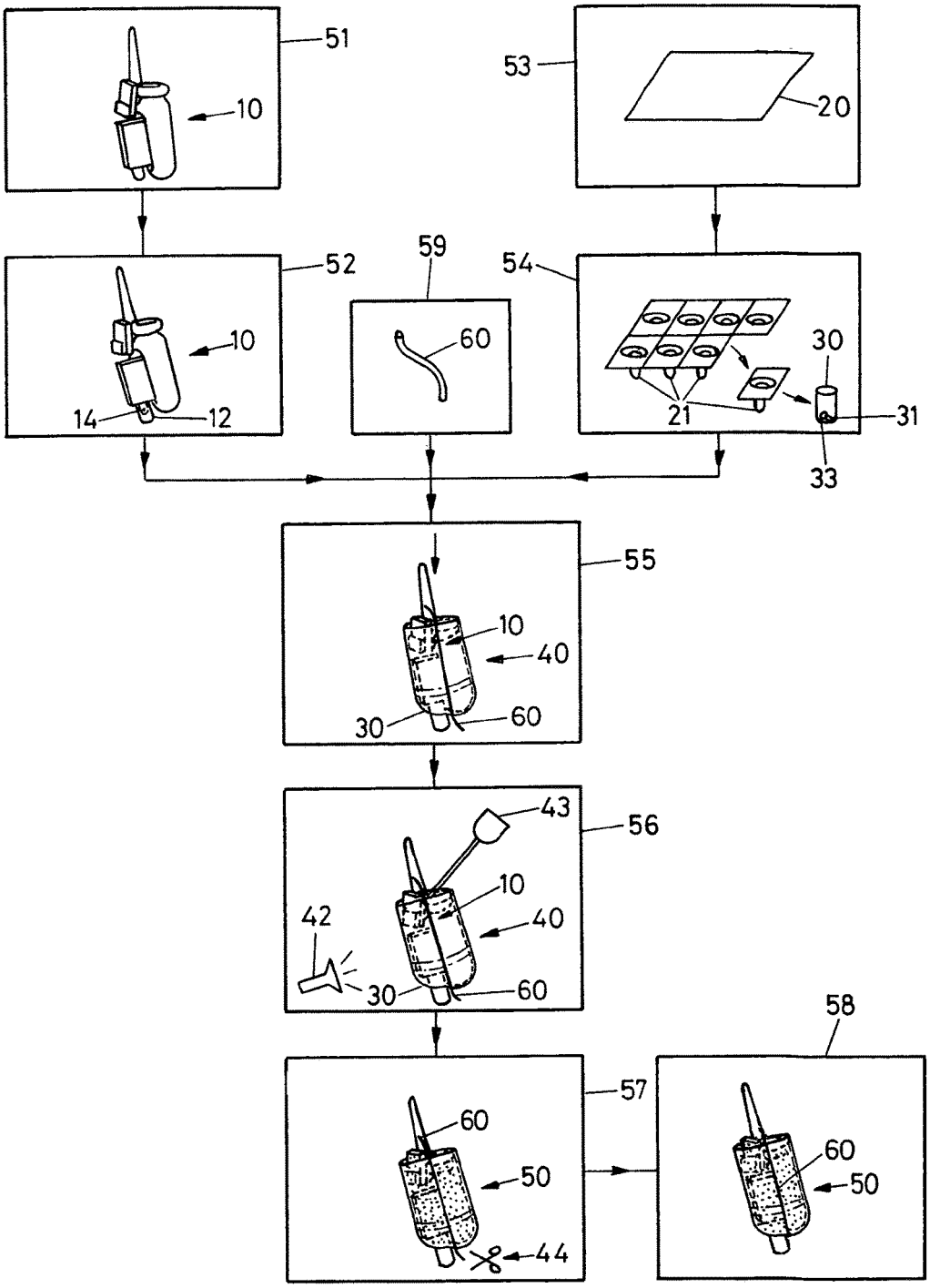
FIG. 8—a flowchart of a method of manufacturing a hearing device according to the further embodiment of the invention.

FIG. 8 illustrates the overall process of manufacturing the second embodiment hearing device of FIG. 7 in block-diagram form. In block 51, the electronics module 10 is provided, and in block 52, tube 14 (if required) is applied and bonded (if necessary) to the sound outlet 12 of the electronics module 10. In block 59, a length of vent tube 60 is provided. In block 53, a sheet 20 of thermoformable material is provided, and in block 54 the sheet 20 is thermoformed into hull blanks 21, which are separated from the sheet, trimmed (if required), and pierced with opening 31 and further opening 33 e.g. by means of laser cutting, thereby resulting in hull 30. In block 55, the electronics module 10 is inserted into the hull 30 along with vent tube 60 which protrudes from further opening 33, creating an assembled hearing device 40. In block 56, the electronics module 10 and vent tube 60 are encapsulated into the hull 30 by means of an appropriate adhesive, e.g. a UV or light-curable epoxy, which may be applied by a cannula 41 and cured by means of a UV light source 42, and in block 57 the fully assembled and encapsulated hearing device 50 is completed by trimming the loose ends of the vent tube 60 to the desired length or flush with the encapsulation material and the hull 30 by means of trimming device 44, resulting in a completed hearing device 50 in block 58.

Although the invention has been described in terms of specific embodiments, variations therefrom are possible without departing from the scope of the invention as defined by the appended claims.

What is claimed is:

1. An in-the-ear hearing device, comprising:
- a single-piece thermoformed hull with a first opening and a second opening;
- an electronics module comprising a microphone, a battery, and a loudspeaker,
  - wherein the electronics module is disposed in the single-piece thermoformed hull,
  - wherein the microphone is communication with the first opening,
  - wherein the first opening is configured to provide sound to the microphone,
  - wherein the loudspeaker is in communication with the second opening,
  - wherein the second opening is configured enable the output of sound,
    - wherein the entire electronics module is encapsulated by the single-piece thermoformed hull,
    - wherein the battery is hardwired to the electronics module without a battery compartment separate from the single-piece thermoformed hull, and
    - wherein the single-piece thermoformed hull is configured to be positioned within an ear canal;
- adhesive that adheres to the single-piece thermoformed hull, and
  - wherein the adhesive fills gaps between the electronics module and the single-piece thermoformed hull.

2. The hearing device of claim 1, wherein a tube is attached to the second opening.

3. The hearing device of claim 2, wherein the tube protrudes through the second opening in to the single-piece thermoformed hull.

4. The hearing device of claim 2, wherein the tube is substantially cylindrical or hollow-truncated-conical.

5. The hearing device of claim 1, wherein the electronics module is physically coupled to an extraction loop proximate to the first opening.

6. The hearing device of claim 1, further comprising a silicone ear mold or a compressible seal disposed around the hull.

7. The hearing device of claim 1, wherein the hull is sized such that it is deformed by the electronics module.

8. The hearing device of claim 1, further comprising a vent tube inside the hull and having a first end in communication with first opening.

9. A method of manufacturing an in-the-ear hearing device comprising:
- providing a sheet of thermoformable material;
- thermoforming and separating a hull blank from the sheet of thermoformable material, said hull blank comprising an open end and a closed end;
- forming at least one opening in the closed end of the hull blank, thereby forming a hull;
- providing an electronics module comprising a microphone in communication with a sound inlet, a battery, and a loudspeaker in communication with a sound outlet;
- inserting the entire electronics module into the hull such that the sound outlet is in communication with the opening;
- filling the hull and the electronics module with the exception of at least part of the sound inlet and at least part of the sound outlet into the hull with an adhesive, wherein:
  - the battery is hardwired to the electronics module without a battery compartment separate from the hull;

the adhesive adheres to the hull, the adhesive fills gaps between the electronics module and the hull, and wherein the hull is configured to be positioned within an ear canal.

10. The method according of claim 9, further comprising: attaching a tube to the sound outlet.

11. The method to claim 10, wherein the hull at least partially prevents moisture from entering the electronics module.

12. The method of claim 9, further comprising:

forming an additional opening on the closed end of the hull blank; and inserting a vent tube into the hull blank.

13. The method of claim 12, further comprising:

trimming excess vent tube material such that the vent tube is flush with or protrudes less than or equal to 2 mm from the hull.

14. The method of claim 9, wherein the hull blank is separated from the sheet of thermoformable material by laser cutting or hot-wire cutting, and wherein the at least one opening is formed by laser cutting or die cutting.

15. The method of claim 9, wherein the thermoformable material includes at least one of the following: BAREX, PET-GAG, COP, PEEK, or any combination thereof.

16. The method of claim 9, wherein, the adhesive is applied by means of a cannula.

17. The method of claim 9, wherein the adhesive is a UV- or light-curable epoxy, and wherein the adhesive is cured by UV radiation or light.

* * * * *